US005522109A

United States Patent [19]

Chan

[11] Patent Number: 5,522,109

[45] Date of Patent: Jun. 4, 1996

[54] DOUBLE-HEADED TOOTHBRUSH

[76] Inventor: Boon Su Chan, Batu 10¼ Kubang Jelai Jalan Tokai, 06660 Alor Setar, Kedah, Malaysia

[21] Appl. No.: 352,533

[22] Filed: Dec. 9, 1994

[30] Foreign Application Priority Data

Dec. 13, 1993 [MY] Malaysia ..... PI 930 2690

[51] Int. Cl.[6] ..... A46B 9/04

[52] U.S. Cl. ..... 15/106; 15/167.1; 15/185; D4/105; D4/108; D4/112; D4/113

[58] Field of Search ..... 15/106, 167.1, 15/167.2, 184, 185; D4/104, 105, 108, 112, 113

[56] References Cited

U.S. PATENT DOCUMENTS

| | | | |
|---|---|---|---|
| D. 47,669 | 8/1915 | Hunt | D4/105 |
| D. 100,558 | 7/1936 | Hachman | D4/105 |
| D. 121,437 | 7/1940 | Hadden | 15/167.1 |
| D. 310,914 | 10/1990 | Ambasz | D4/108 |
| 611,788 | 10/1898 | Lincoln . | |
| 1,041,315 | 10/1912 | Marx | 15/185 |
| 1,052,539 | 2/1913 | Welch | 15/185 |
| 1,607,448 | 11/1926 | Dykes | 15/185 |
| 2,161,349 | 6/1939 | Hadden | 15/106 |
| 2,534,439 | 12/1950 | Grandjean | 15/185 |
| 2,608,293 | 8/1952 | Carlson | 15/185 |
| 2,657,412 | 11/1953 | Carlson | 15/167.1 |
| 4,033,007 | 7/1977 | Hadary | 15/172 |
| 4,109,339 | 8/1978 | Dietrich | 15/167.1 |
| 4,370,773 | 2/1983 | Hadary | 15/172 |
| 4,454,623 | 6/1984 | O'Halloran | 15/167.1 |
| 4,463,470 | 8/1984 | Willis | 15/167.1 |
| 4,524,478 | 6/1985 | Ross | 15/106 |
| 5,165,135 | 11/1992 | Su | 15/167.1 |

FOREIGN PATENT DOCUMENTS

| | | | |
|---|---|---|---|
| 58049/86 | 12/1987 | Australia . | |
| 2494097 | 5/1982 | France | 15/167.1 |
| 155286 | 4/1991 | Taiwan . | |
| 623575 | 5/1949 | United Kingdom . | |
| 1396634 | 6/1975 | United Kingdom | 15/184 |
| 2224928 | 5/1990 | United Kingdom . | |

*Primary Examiner*—Mark Spisich

*Attorney, Agent, or Firm*—Merchant, Gould, Smith, Edell, Welter & Schmidt

[57] ABSTRACT

A toothbrush comprises an elongate element with a brushhead on each end. The elongate element (10) is composed of a first curved portion (10*a*, 10*b*) on one end and a corresponding second curved portion (10*b*, 10*a*) on the other end. Each curved portion further comprises an outer section (14) and a holder section (12) integrally connected by a gooseneck shaped middle section (13), with the brushhead attached to the free end of the outer section such that the longitudinal axis of the brushhead (20, 30) is disposed at an angle to the longitudinal axis of the adjacent outer section (14) of the element (10). The toothbrush is pivotally fitted with a rotatable cover-cum-handle that allows either brushhead-carrying curved portion (10*a*, 10*b*) of the elongate element to be exposed and concealed in turn.

18 Claims, 4 Drawing Sheets

DOUBLE-HEADED TOOTHBRUSH

TECHNICAL FIELD

Figures 1A, 1B, 1C, 1D:
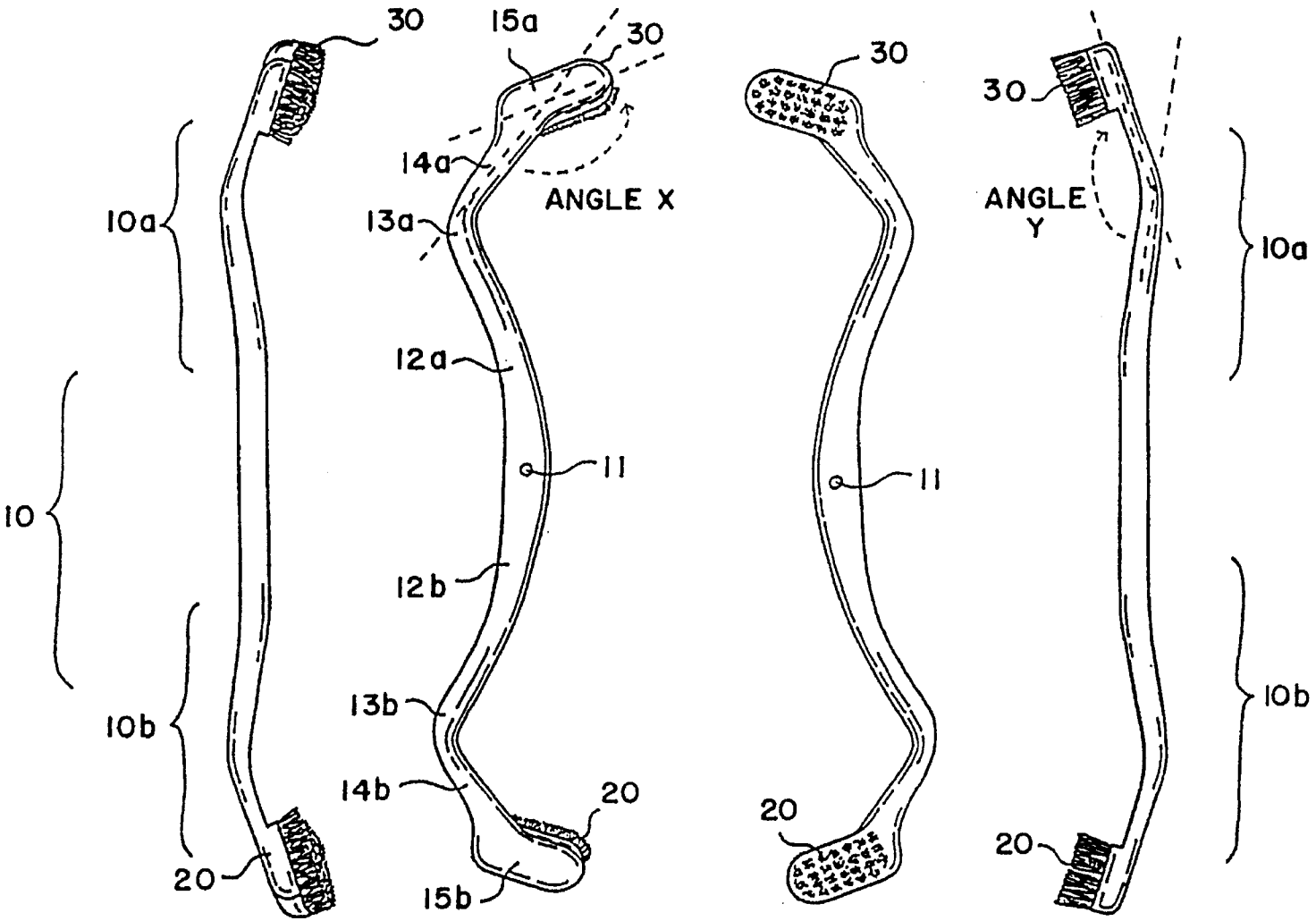
Figures 2A, 2B:
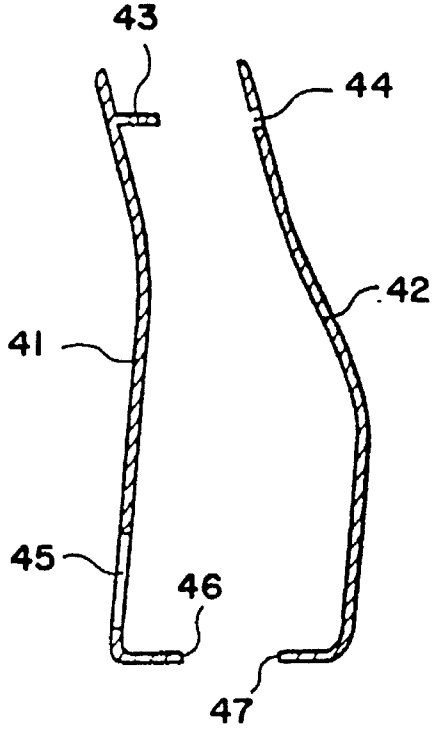
Figure 2E:
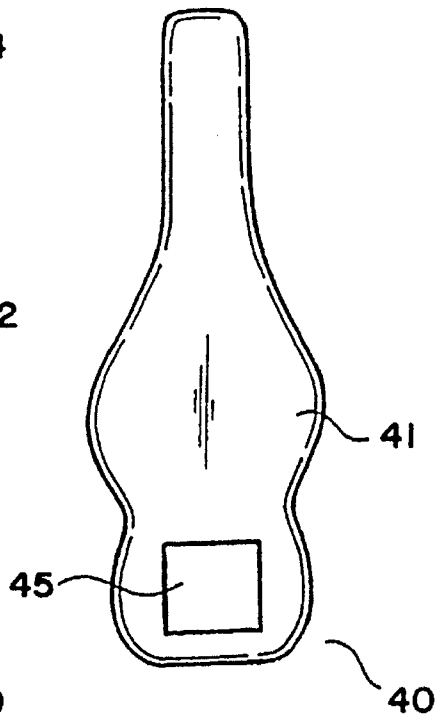
Figure 2D:
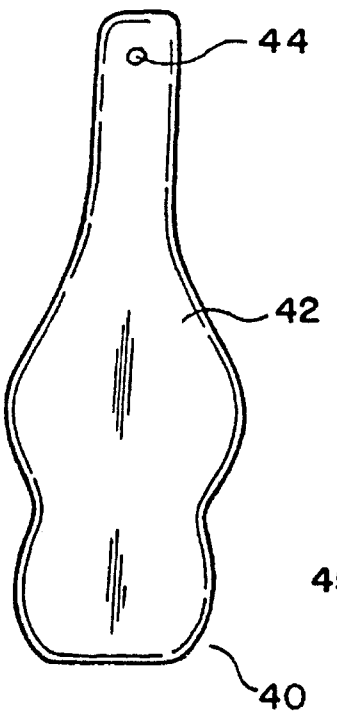
Figure 2C:
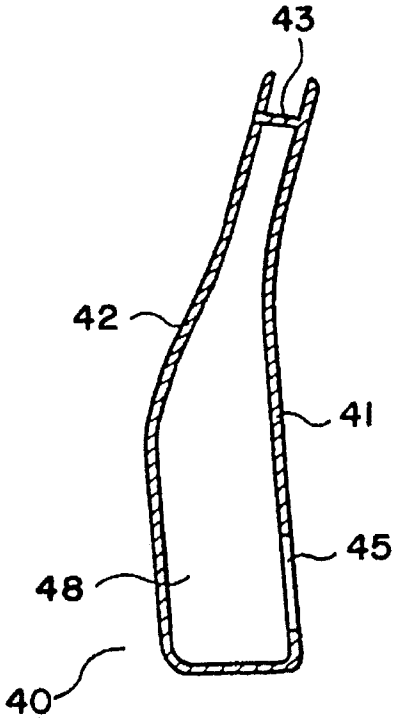
Figure 3D:
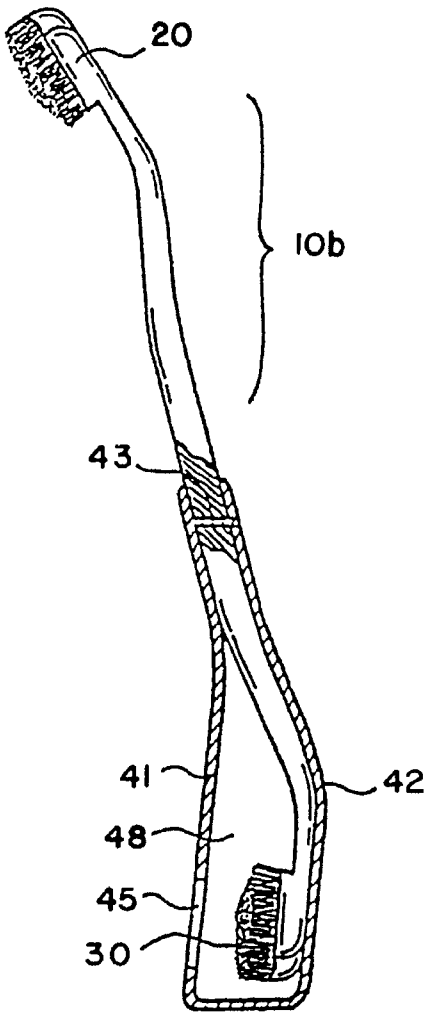
Figure 3B:
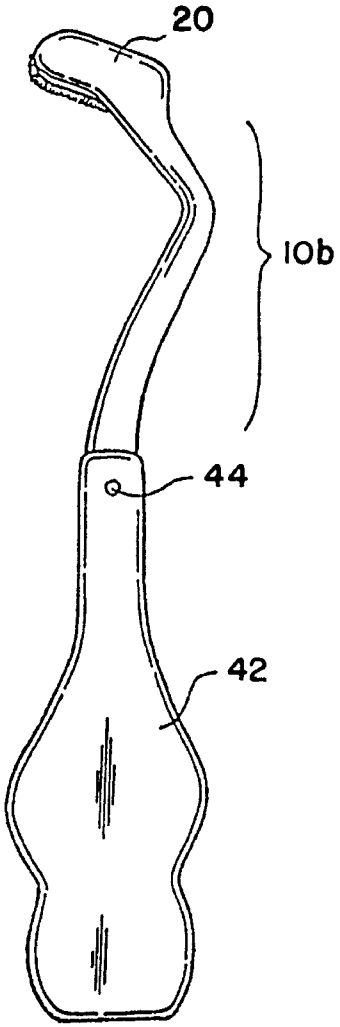
Figure 3A:
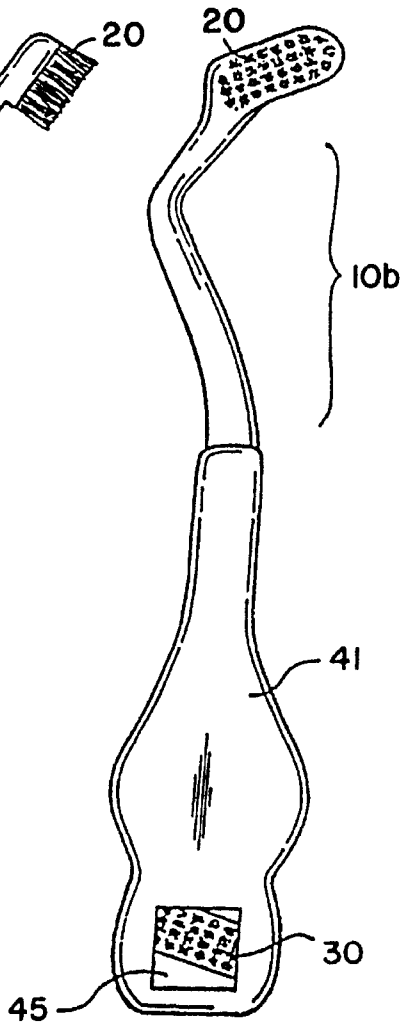
Figure 3C:
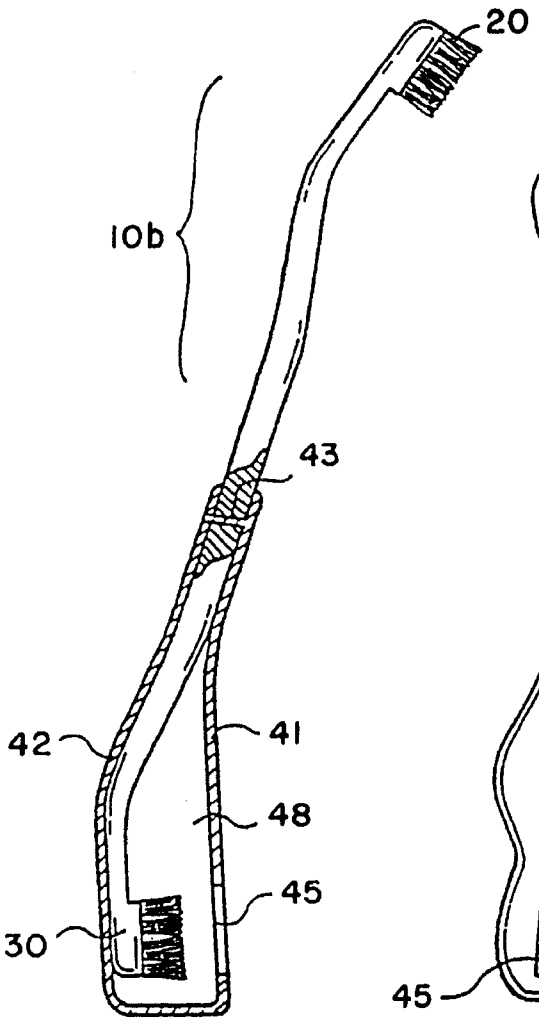
Figures 4A, 4B, 4C, 4D:
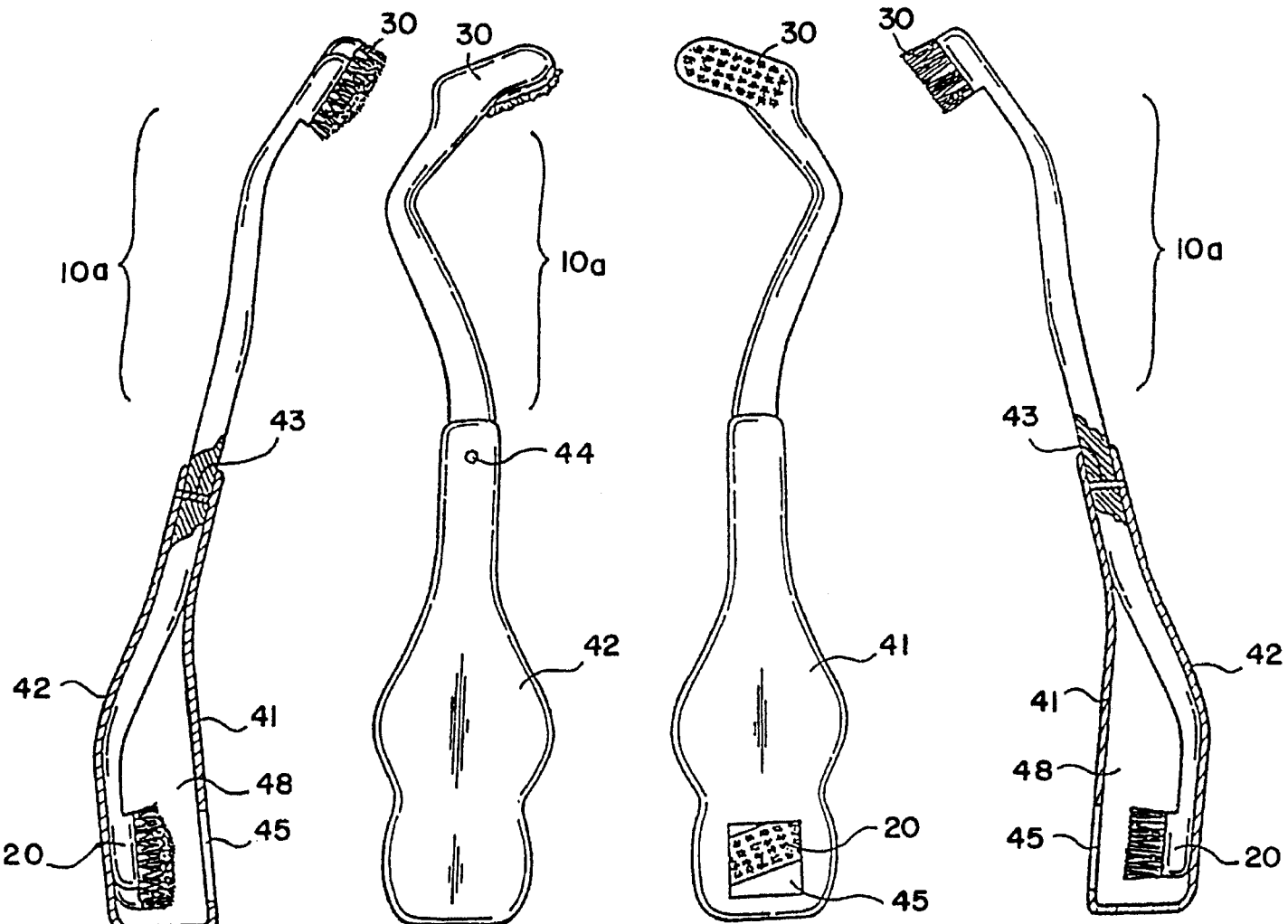

The invention relates generally to toothbrushes, and more particularly to a novel construction of a toothbrush with one brushhead on either end of an element, half of the element being slidably concealed in a pear-shaped receptacle cover.

BACKGROUND ART

Toothbrushes for cleaning teeth, with the bristle-carrying brushhead aligned with the handle, are commonly known objects. Though it is universally recognised that the most efficient way to clean the teeth is to move the brush up and down, presently available toothbrushes from the market do not facilitate this movement, the axis of the brushhead being in line with the axis of the handle.

U.S. Pat. No. 611788 of Oct. 4, 1898 by Isaac N Lincoln disclosed a folding toothbrush, with a jointed handle, one part provided with bristles, and the other part consisting of a receptacle for tooth powder, a series of perforations extending longitudinally from either end of the receptacle.

U.S. Pat. No. 4033007 and 4370773 respectively dated Jul. 5, 1979 and Feb. 1, 1983 by Joseph Hadery disclosed a toothbrush with an upright, self-supporting handle having a diametrically enlarged hollow base of a size to receive and store a brushhead therein.

Australian Patent No. AU-A-58049/86 by Raymond Ernest and Stephen J Ginsberg dated Dec. 3, 1987 disclosed a modular oral hygiene system with a handle comprising generally parallel front and rear portions connected by a middle portion which forms an angle of about 30 to about 50 degrees with said front and rear portions.

U.S. Pat. No. 5165135 and UK Patent No. 2224928 dated respectively Nov. 24, 1992 and Apr. 8, 1992 by Chan Boon Su disclosed a toothbrush comprising essentially: an elongate handle, an elongate bristle-carrying head on the distal end of the said handle, a suitable means of turning the brushing head about an axis parallel to the longitudinal axis of the brushing head, and the longitudinal axis of the head forming an angle to the longitudinal axis of said handle. The subject of this disclosure is a toothbrush having one brushhead attached to each end of an elongate element, with each half of the element further comprising an outer portion and a holder portion integrally connected by a middle portion shaped like a goose-neck.

The longitudinal axis of the bristle-carrying brushhead is disposed at an angle to the longitudinal axis of the adjacent outer section of the element; and the plane containing the longitudinal axis of the outer section of the element is disposed at an angle to the plane containing the longitudinal axis of the holder section of the element. The first half of the element with an attached brushhead is the mirror-image of the second half of the element with an attached brushhead, and the element substantially assumes an extended "M" shape.

SUMMARY OF THE INVENTION

It is an object of the invention to encourage brushing the teeth in an up and down manner.

It is another object of the invention to provide a toothbrush capable of efficiently brushing the buccal and lingual surfaces of the teeth.

It is another object of the invention to provide a toothbrush that is easy and economical to manufacture and that lends itself to mass production.

It is yet another object of the invention to avoid turning the brushhead.

These objects are achieved by three working models disclosed in the following description. To those skilled in the art, other models and modifications are possible following the disclosure of this invention. In one preferred model, a bristle-carrying brushhead is attached at either end of an elongate element, half of the element with the brushhead being slidably concealed within a cavity formed in a receptacle cover which pivotally supports said element at its centre. The longitudinal axis of the bristle-carrying brushhead is disposed at an angle to the longitudinal axis of the adjacent portion of the element.

In another model, the elongate element with two bristle-carrying brushheads is used directly without the receptacle cover.

Yet another model comprises one half of the element with its brushhead is the mirror image of the other half of the element with its brushhead.

SPECIFIC EXAMPLE

The foregoing and other objects and advantages will be apparent from the description below of the two models: one provided with a receptacle cover and the other without.

The characteristics and the purposes will be clearly seen in the accompanying drawings.

FIG. (1*a*) shows the front view of a toothbrush made according to the invention comprising an elongate element (10) carrying a bristle-carrying brushhead at either end.

FIG. (1*b*) shows the back view of the element as shown in FIG. (1*a*).

FIG. (1*c*) shows a left side view of the element as shown in FIG. (1*a*).

FIG. (1*d*) shows a right side view of the element as shown in FIG. (1*a*).

FIG. (2*a*) shows the right side cross section view of a first asymmetrical half representing the front half of the receptacle cover.

FIG. (2*b*) shows the right side cross section view of the second asymmetrical half representing the back half of the receptacle cover.

FIG. (2*c*) shows the left side view of a fully assembled receptacle cover.

FIG. (2*d*) shows the back view of the cover as shown in FIG. (2*c*).

FIG. (2*e*) shows the front view of the cover as shown in FIG. (2*c*).

FIG. (3*a*) shows the front view of the preferred model according to the invention, in first alternate position, with half of the elongate element concealed in a receptacle cover.

FIG. (3*b*) shows the back view of the toothbrush as shown in FIG. (3*a*).

FIG. (3*c*) shows a left side view of the toothbrush as shown in FIG. (3*a*).

FIG. (3*d*) shows a right side view of the toothbrush as shown in FIG. (3*a*).

FIG. (4*a*) shows the front view of the toothbrush according to the invention, in second alternate position, with the element rotated a full turn.

FIG. (4*b*) shows the back view of the toothbrush as shown in FIG. (4*a*).

FIG. (4*c*) shows a left side view of the toothbrush as shown in FIG. (4*a*).

FIG. (4*d*) shows a right side view of the toothbrush as shown in FIG. (4*a*).

For the sake of convenience and clarity, common numerals are used to refer to common parts or components described in the invention. Where it is necessary to differentiate them, a suffix "a" or "b" is added to the common numerals.

With reference to FIGS. (1*a*), (1*b*), (1*c*), and (1*d*), the element (10) in one model of the toothbrush according to the invention is elongate. The element (10) comprises one curved portion (10*a*) integrally moulded with a second mirror-image curved portion (10*b*), so that the element (10) looks similar to an extended "M" shape. Substantially at the junction of the two portions (10*a*, 10*b*), there is provided a central hole (11) whereby a pivoting element from a receptacle cover (not shown) is applied, when it is desirable to cover half of the element (10). Otherwise, as in another model, the central hole (11) is not provided and the element (10) with double brushheads (20, 30) will be used directly as a handle of the toothbrush.

The curved portion (10*a*, 10*b*) of the element further comprises outer (14*a*, 14*b*) and holder (12*a*, 12*b*) sections connected integrally with a middle section (13*a*, 13*b*) which forms generally a goose-neck with said outer (14*a*, 14*b*) and holder (12*a*,12*b*) sections. The goose-neck middle section (13*a*, 13*b*) allows for smooth brushing unhampered by the confines of the mouth.

The extreme end (15*a*, 15*b*) of said outer (14*a*, 14*b*) section is enlarged and flattened. A bristle-carrying brushhead (20, 30) is ultrasonically attached to this enlarged and flattened end (15*a*, 15*b*), such that a substantial section of the bristle-carrying brushhead (20, 30) projects away from the adjacent outer section (14*a*, 14*b*). It is therefore important for the brushhead (20, 30) and the enlarged end (15*a*, 15*b*) to be made of the same plastic material.

The longitudinal axis of the enlarged end (15*a*, 15*b*) and the brushhead (20, 30) is preferably at an angle "x" to the longitudinal axis of the adjacent outer section (14*a*, 14*b*) of the element (10). The angle "x" is preferably about 100 to 175 degrees from the longitudinal axis of the outer section (14*a*, 14*b*) of the element (10). The plane containing the longitudinal axis of the enlarged end (15*a*, 15*b*) and the brushhead (20, 30) is also disposed at a sloping angle "y" to the plane containing the longitudinal axis of the holder section (12*a*, 12*b*) of the element (10). The angle "y" is preferably about 100 to 175 degrees from the plane containing the longitudinal axis of the holder section (12*a*, 12*b*) of the element (10).

Now referring to FIGS. (2*a*), (2*b*), (2*c*), (2*d*), and (2*e*), a receptacle cover (40) is formed from two asymmetrical halves (41, 42) which is ultrasonically fused at its mating edges (46, 47). There is preferably provided a squarish window (45) towards its base on the first half (41), to expose the brushhead inside the receptacle cover (40) for the convenience of applying tooth paste. The first half (41) is conveniently described as the front half of the cover. Towards the narrow end of the first front half (41), there is integrally and inwardly provided a short protrusion which acts as a pivot element (43). There is no window (45) on the second half (42). The second half (42) can be conveniently described as the back half of the cover. An opening (44) is provided at a corresponding position towards the narrow end of the back half (42), in order to receive the end of the pivot element (43).

When the element (10) is provided with the receptacle cover (40) as shown in FIGS. (3*a*), (3*b*), (3*c*), (3*d*), (4*a*), (4*b*), (4*c*) and (4*d*), this pivot element (43) connect, the upper two halves of the cover (41, 42). One brushhead (20, 30) is exposed while the other brushhead (30, 20) is slidably concealed in the cavity (48) formed between the two asymmetrical halves (41, 42) when they are fused together. The first and second halves (41, 42) are preferably pear-shaped. To allow for free rotation of the curved portions of the element (10) in and out of the cover, the sides of the cover (40) are advantageously open.

I claim:

1. A toothbrush comprising one brush head provided at each end of an elongate element, each brush head having an elongate and substantially planar base and bristles secured thereto, the brush heads facing to the same side of the elongate element, the part of the element leading to each brush head comprising an elongate outer portion connected to the brush head and an elongate holder portion connected to the outer portion, the longitudinal axis of each brush head being disposed at a first obtuse angle to the longitudinal axis of the respective adjacent outer portion of the element, the longitudinal axis of each brush head being disposed at an angle to the longitudinal axis of the respective holder portion of the element; a plane containing the longitudinal axis of each outer portion of the element being disposed at a second obtuse angle to a plane containing the longitudinal axis of the respective adjacent holder portion of the element, and a plane defined by the planar base of each brush head is substantially parallel to the longitudinal axis of the respective adjacent outer portion of the element.

2. A toothbrush as claimed in claim I, wherein each outer portion is integrally connected to the respective adjacent holder portion through a goose-neck middle portion.

3. A toothbrush as claimed in claim 1, wherein a first part of the element with one said attached brush head is the mirror-image of a second part with one said attached brush head, and the element therefore substantially assumes an extended "M" shape.

4. A toothbrush as claimed in claim 1, wherein each bristle-carrying brush head is attached to the respective adjacent portion of the element by ultrasonic means.

5. A toothbrush as claimed in claim 1, wherein the brush heads and the element are made of similar plastics material.

6. A toothbrush as claimed in claim 1, wherein an extreme end of each said outer portion is enlarged and flattened and is attached proximate an end of the respective brush head, and a substantial section of the respective brush head projects at an angle away from the respective adjacent outer portion.

7. A toothbrush as claimed in claim 1, wherein the said first obtuse angle is about 100 to 175 degrees from the longitudinal axis of the respective outer portion of the element.

8. A toothbrush as claimed in claim 1, wherein the said second obtuse angle is about 100 to 175 degrees from the plane containing the longitudinal axis of the respective holder portion of the element.

9. A toothbrush as claimed in claim 1, wherein a receptacle is provided to receive a selected one of the brush heads of the toothbrush.

10. A toothbrush as claimed in claim 9, wherein the receptacle receives one half of the toothbrush.

11. A toothbrush as claimed in claim 10, wherein said receptacle pivotally supports said element so that one half of said element and corresponding brush head is rotatably concealed in a cavity defined in the receptacle while the other half of the element and corresponding brush head is exposed.

12. A toothbrush as claimed in claim 10, wherein the receptacle comprises two asymmetrical halves.

13. A toothbrush as claimed in claim 10, wherein the receptacle comprises a front half and a back half, defining a cavity therein which is accessible from first and second sides of the receptacle.

14. A toothbrush as claimed in claim 13, wherein there is provided a window in one half through which a brush head received within the receptacle is accessible.

15. A toothbrush as claimed in claim 1, wherein one half of the elongate element with one said attached brush head is the mirror-image of the other half of the element with the attached brush head and each holder portion of the element is straight and used as a handle.

16. A toothbrush comprising one brush head provided at each end of an elongate element, the brush heads facing to the same side of the elongate element, the part of the element leading to each brush head comprising an elongate outer portion connected to the brush head and an elongate holder portion connected to the outer portion, the longitudinal axis of each brush head being disposed at a first obtuse angle to the longitudinal axis of the respective adjacent outer portion of the element; a the plane containing the longitudinal axis of each outer portion of the element being disposed at a second obtuse angle to a plane containing the longitudinal axis of the respective adjacent holder portion of the element; and a receptacle pivotally supporting the element so that one half of the element and its corresponding brush head are rotatably concealed in a cavity defined in the receptacle while the other half of the element and corresponding brush head are exposed.

17. A toothbrush comprising one brush head provided at each end of an elongate element, the brush heads facing to the same side of the elongate element, the part of the element leading to each brush head comprising an elongate outer portion connected to the brush head and an elongate holder portion connected to the outer portion, the longitudinal axis of each brush head being disposed at a first obtuse angle to the longitudinal axis of the respective adjacent outer portion of the element; a plane containing the longitudinal axis of each outer portion of the element being disposed at a second obtuse angle to a plane containing the longitudinal axis of the respective adjacent holder portion of the element; and a receptacle adapted to receive a selected one of said brush heads and one half the element adjacent the selected brush head the receptacle comprises a front half and a back half defining a cavity therein which is accessible from first and second opposite sides of the receptacle.

18. A toothbrush as claimed in claim 17, wherein there is provided a window in one half of the receptacle through which a brush head received within the receptacle is accessible.

* * * * *

UNITED STATES PATENT AND TRADEMARK OFFICE

CERTIFICATE OF CORRECTION

PATENT NO. : 5,522,109

DATED : June 4, 1996

INVENTOR(S) : Chan

It is certified that error appears in the above-identified patent and that said Letters Patent is hereby corrected as shown below:

Col. 4, line 5 "connect," should read --connects--

Col. 5, line 27 delete "the" after the word "a"

Col. 6, line 21 "head the" should read --head; the--

Signed and Sealed this

Fourth Day of February, 1997

*Attest:*

Bruce Lehman

BRUCE LEHMAN

*Attesting Officer*

*Commissioner of Patents and Trademarks*